US005165504A

United States Patent [19]

Lecorre

[11] Patent Number: 5,165,504

[45] Date of Patent: Nov. 24, 1992

[54] APPARATUS FOR DISPLACING AN ARTICLE IN PARALLEL WITH THE CURVATURE OF AND IN PROXIMITY TO A SURFACE OF VARIABLE PROFILE

[75] Inventor: Yves Lecorre, St. Nazaire, France

[73] Assignee: Polytec, Saint-Nazaire, France

[21] Appl. No.: 641,007

[22] Filed: Jan. 14, 1991

[51] Int. Cl.[5] ..... B66B 9/20

[52] U.S. Cl. ..... 187/12; 187/10; 187/95; 105/29.1; 414/592; 414/782

[58] Field of Search ..... 187/6, 7, 10, 12, 19, 187/95; 104/127, 128; 105/29.1, 29.2; 414/592, 595, 596, 597, 598, 599, 600, 648, 649, 650, 782; 182/45, 141, 142, 148

[56] References Cited

U.S. PATENT DOCUMENTS

| | | | |
|---|---|---|---|
| 56,947 | 8/1866 | Jenks | 187/12 |
| 517,702 | 4/1894 | Kurtz | 414/495 |
| 1,824,340 | 9/1931 | Geiger | 414/592 |
| 1,946,982 | 2/1934 | McPeak | 414/592 X |
| 3,891,062 | 6/1975 | Geneste | 187/95 X |
| 4,235,305 | 11/1980 | Nygren | 187/6 X |
| 4,257,491 | 3/1981 | Presnall, Jr. et al. | 187/6 X |
| 4,427,093 | 1/1984 | Wehmeyer et al. | 187/11 X |
| 4,627,517 | 12/1986 | Bor | 187/12 |
| 4,821,845 | 4/1989 | DeViaris | 187/12 |
| 4,957,189 | 9/1990 | Tanaka . | |

FOREIGN PATENT DOCUMENTS

| | | | |
|---|---|---|---|
| 291739 | 11/1988 | European Pat. Off. | 187/6 |
| 3709082 | 9/1988 | Fed. Rep. of Germany | 187/6 |
| 56-10900 | 2/1981 | Japan | 187/6 |
| 1252277 | 8/1986 | U.S.S.R. | 187/12 |
| 2131760 | 6/1984 | United Kingdom | 187/95 |

*Primary Examiner*—Michael S. Huppert
*Assistant Examiner*—Robert S. Katz
*Attorney, Agent, or Firm*—Pollock, VandeSande & Priddy

[57] ABSTRACT

An apparatus for displacing an article or a person in parallel with the curvature of and in proximity to a surface of variable profile possessing convex and/or concave parts, as the case may be, comprising a support for the article to be displaced in the vicinity of the surface, having at least two guide rollers, engaged respectively in each of two separate rail-forming grooves made in a structure for bearing on the ground which is moveable and which is located as near as possible to the surface, this structure having a profile corresponding substantially to that of this surface, the two rollers being arranged in their respective grooves in such a way that they are always separated by an invariable distance, a motor being provided for displacing the rollers in their grooves, wherein the grooves receiving the rollers are open outwards and provided on either side of a upright belonging to the bearing structure, these grooves having different profiles which are a function of the curvature of the surface and which are arranged in such a way that the line connecting the rollers always remains parallel to itself when these rollers follow the grooves under the effect of the a motor, at the same time forming a constant angle with a given reference line of the support of the article.

8 Claims, 3 Drawing Sheets

APPARATUS FOR DISPLACING AN ARTICLE IN PARALLEL WITH THE CURVATURE OF AND IN PROXIMITY TO A SURFACE OF VARIABLE PROFILE

The present invention relates to an apparatus for displacing an article or a person in parallel with the curvature of and in proximity to a surface of variable profile possessing convex and/or concave parts, as the case may be.

The invention is concerned more particularly, though not exclusively, with an apparatus for displacing a working tool or an operator actuating such a tool or not, brought into and kept in contact with or in the immediate vicinity of the surface, or alternatively a cage for supporting the operator who has to carry out work on this surface.

There are already many known systems of scaffolding or with moveable cages designed to be mounted in the vicinity of the surface of a large-size component or a similar installation, making it possible to follow the profile of this surface in order to carry out on it, machining, finishing or checking work. Now these systems are usually difficult to construct and install, are relatively costly and, above all, are unsuitable for following the sometimes complex profile of the component, especially when this has large dimensions.

There are also known apparatuses which, starting from a given fixed reference, make it possible to cause an article or tool to be displaced in two mutually perpendicular directions. FR-A-2,384,437 thus employs an articulated assembly expandable in a transverse direction and carried by a support displaceable in a perpendicular direction by means of a control jack. Such an appliance is more especially designed for positioning a cage at the rear of an agricultural tractor and at all events would as such be unsuitable for producing an assembly capable of following the profile of a large-size surface in a uniform manner.

On a more sophisticated level, there are likewise known apparatuses which make it possible to follow the profile of any surface by reproducing at every moment the X and Y co-ordinates of the successive points of the latter. However, such an apparatus requires a storage of these co-ordinates and a suitable evaluation in time of the stored data, thus generally involving the use of complex and costly electronic equipment.

Finally, application 89,07403 of 5th Jun. 1989 in the name of the Applicant Company has already described and claimed an apparatus comprising a vertical supporting frame arranged in the vicinity of the surface and a bearing arm consisting of at least one pantograph, of which one end fixed to the vertical supporting frame is displaceable, as required, according to the height of the latter, and the other end of which carries the article to be displaced into contact with the surface, in which apparatus at least one of the axes of articulation of the pantograph arm is displaced, together with the movement of the arm relative to the frame, in a slot, the profile of which matches that of the surface as is located in a vertical plane containing the pantograph arm. The pantograph is preferably formed from at least two adjacent scissors, two ends of the crossed branches of the first scissors being articulated freely on two ends of the likewise crossed branches of the second scissors, the opposite ends of the first scissors being carried by the frame, whilst the opposite ends of the second scissors support the article to be displaced.

Such an assembly, completely mechanical and relatively simple to produce, makes it possible to overcome the disadvantages of the prior solutions, particularly by avoiding a storage of the co-ordinates of the surface, whilst at the same time keeping the article at a proper distance from it, whatever its contour and the variations of the latter. However, this assembly requires the installation of a somewhat elaborate articulated structure.

SUMMARY OF THE INVENTION

The present invention relates to an apparatus of a completely different design which has the advantage, like the preceding one, of avoiding any direct contact with the surface of the component against which this apparatus is to be displaced, said apparatus being simple, robust, of limited maintenance and very easy to use.

For this purpose, the apparatus in question, comprises a support for the article to be displaced in the vicinity of the surface, having at least two guide rollers engaged respectively in each of two separate rail-forming grooves made in a structure for bearing on the ground which is moveable and which is located as near as possible to the surface. This structure has a profile corresponding substantially to that of this surface, the two rollers being arranged in their respective grooves in such a way that they are always separated by an invariable distance. Control means are provided for displacing the rollers in their grooves. The grooves receiving the rollers are open outwards and provided on either side of an upright belonging to the bearing structure, these grooves having different profiles which are a function of the curvature of the surface. The grooves are arranged in such a way that the line connecting the rollers always remains parallel to itself when these rollers follow the grooves under the effect of the control means, at the same time forming a constant angle with a given reference line of the support of the article.

In a preferred embodiment of the invention, the angle formed by the line connecting the rollers and the reference line of the support is in the neighborhood of 45°.

The invention involves particularly giving the profiles of the grooves receiving the rollers respective curvatures designed specifically to ensure that the abovementioned angle remains permanently constant, the reference line of the support of the article accordingly always remaining parallel to itself. In particular, the grooves are arranged in such a way that they can mutually intersect in space, without the risk that they may be capable of interfering directly with one another, as a result of their separate positions on either side of the upright which incorporates them.

Preferably, the support of the article consists of a plane plate, through which pass a first and a second transverse shaft, the first shaft being mounted rotatably and the second being immobilized relative to the plate, the guide rollers being fixed to the ends of these two shafts.

In a preferred embodiment of the invention, the apparatus comprises four guide rollers arranged respectively in pairs at the ends of the two transverse shafts, these rollers being associated in pairs in open grooves provided respectively on two uprights of the bearing structure which are parallel to one another and which are arranged on each side of the plate.

According to another special characteristic of the invention, one of the rollers is mounted and detained at the end of the first rotary shaft and is associated with a pinion for controlling the displacement of the plate, likewise keyed on the shaft and arranged in a plane parallel to that of the roller, this pinion driven by a motor carried by the plate engaging with a chain or a toothing mounted and immobilized in the bottom of the groove receiving this roller. Advantageously, the other roller is mounted loosely on an axle parallel to the second shaft and is carried by a crank pin, itself fixed to the end of this shaft, this crank pin being keyed on this shaft with a specific fixed orientation, defining, in combination with the position of the two shafts on the plate, the invariable distance between the two rollers.

According to yet another characteristic, each lateral upright of the bearing structure comprises a central metal web, to the opposite faces of which are welded or otherwise fastened bent sections of U-shaped cross-section, delimiting the open grooves receiving the rollers with a play within these grooves which is cancelled, depending on whether the roller rolls on one of the opposite sides of the section or the other, as a function of the direction of displacement of the support of the article in relation to the bearing structure.

Advantageously, the plate supports a protective cage for an operator, which is displaced according to the height of the structure in relation to the surface. The bearing structure is mounted on wheels, so that it can be displaced on the ground and shifted as far from or as near to the surface as possible. Finally, preferably, the bearing structure possesses means for immobilization on the ground and, if appropriate, means for inclining its uprights, so that these can be brought into the immediate vicinity, of the profile of the surface.

DESCRIPTION OF THE FIGURES

Other characteristics of an apparatus designed according to the invention will also emerge from the following description of an exemplary embodiment given as a non-limiting indication with reference to the accompanying drawings in which.

DESCRIPTION OF THE PREFERRED EMBODIMENT

Figure 1:
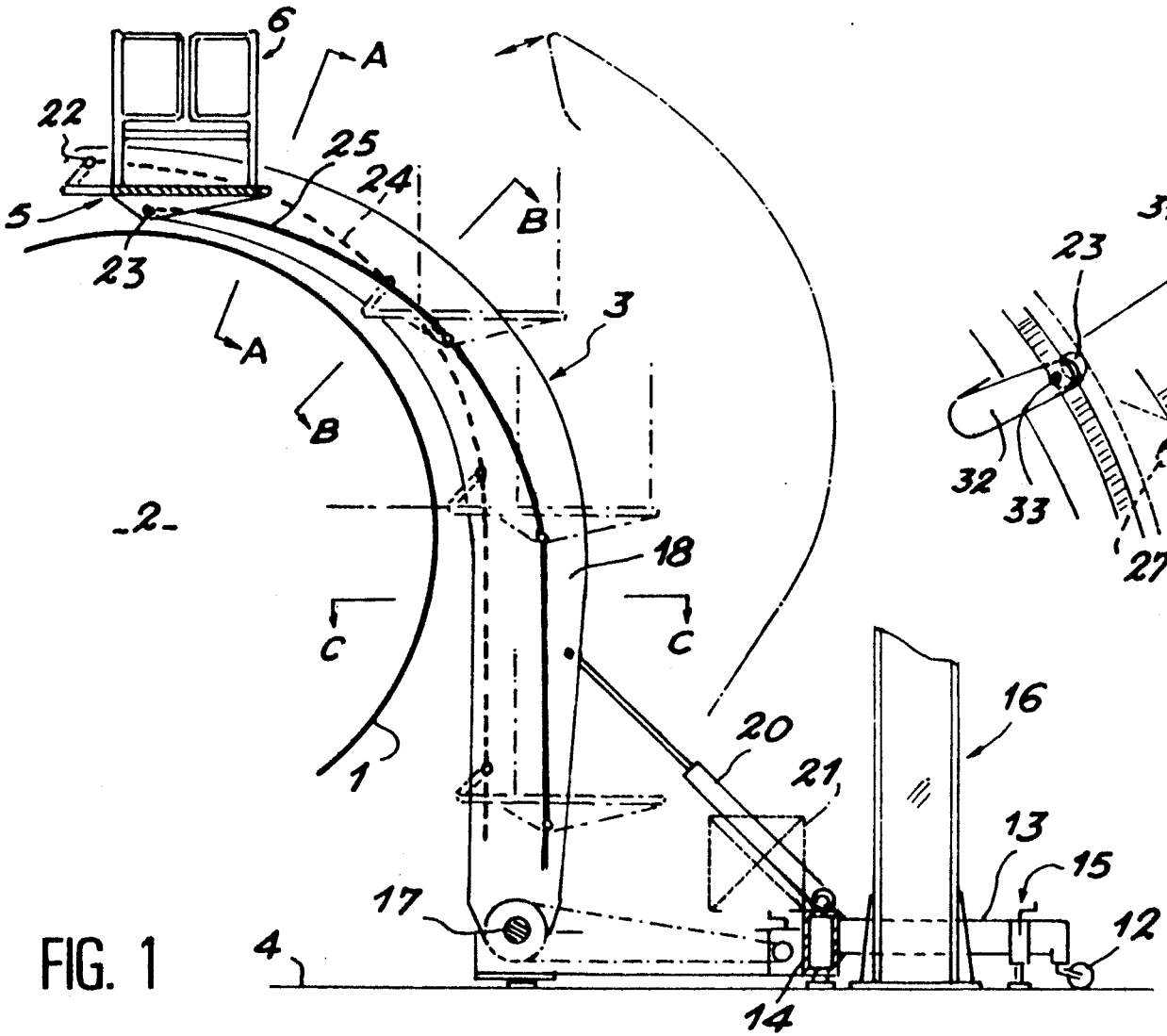
FIG. 1 is an elevation view of the apparatus in question, making it possible to obtain the displacement of an article or a person in the vicinity of a large-size component having a curved surface of a profile which is uniform or variable, continuous or not and concave or convex.
Figure 2:
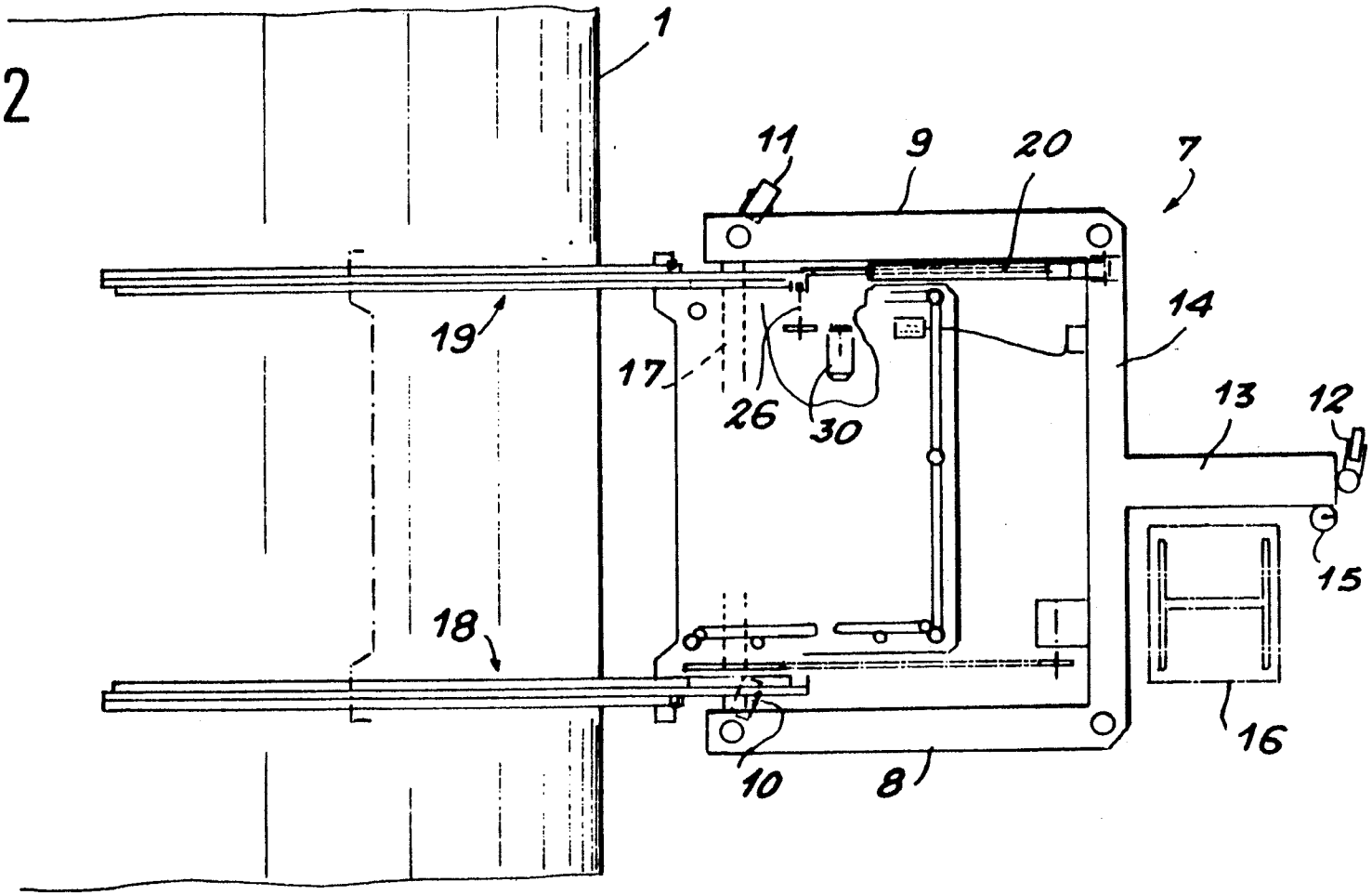
FIG. 2 is a top view of the apparatus according to FIG. 1 on a larger scale.

In the drawings, especially in FIGS. 1 and 2, the reference 1 denotes the outer surface of any large-size size component 2 of the tank, vessel or such like type which is to be followed by means of any article, especially a tool or a checking appliance (not shown) for checking its profile or working on this.

According to the invention, a structure 3 for bearing on the ground 4, intended for the support 5 of the article, is arranged in the vicinity of the surface 1, this support preferably consisting of the lower plate of a cage 6, and the latter can directly support the tool or, in the same way, carry an operator (not shown) working, as required, on the surface using said tool.

The structure 3 comprises a base 7 preferably having a U-shaped profile, of which the lateral sides 8 and 9 respectively are equipped with wheels 10 and 11, making it possible to displace the structure on the ground 4 in combination with a third wheel 12 mounted at the end of a middle arm 13 extending parallel to the lateral sides 8 and 9 substantially in the center of a connecting beam 14 arranged perpendicularly between these sides. The wheels 10 and 11 are equipped with a suitable system (not shown) for locking, once the structure is appropriately positioned in front of the surface 1 of the component 2, a jack 15 also being provided in the vicinity of the middle wheel 12 in order to immobilize the assembly in the final position. The mounting of the wheels 10, 11 and 12 of the base 7 thus allow the latter to be displaced in any suitable direction and to adjust its position relative to the component 2 before immobilization, particularly avoiding being impeded by stationary elements arranged, if appropriate, in the vicinity of the component, such as, for example, the post 16 illustrated in FIGS. 1 and 2.

The base 7 has a transverse axle 17, on which is articulated the actual bearing structure 3, this preferably comprising two lateral uprights 18 and 19 respectively extending in two vertical planes parallel to the lateral sides 8 and 9 of the base 7. Jacks 20 are provided between the base and a suitable point of articulation on the uprights 18 and 19, so as to make it possible to raise or lower these appropriately in order to arrange the structure as near as possible to the surface 1, the uprights possessing by virtue of construction a profile of which the curvature is substantially similar to that of the surface 1, so as partially to envelope the latter, as shown diagrammatically in the elevation view of FIG. 1.

According to the invention, the supporting plate 5 with its cage 6 is intended to be displaced along the uprights 18 and 19 of the bearing structure 3, whilst at the same time always remaining parallel to itself and, in particular in the example in question, always horizontal, the overhang of the cage in relation to the structure being effectively balanced by means of a counterweight 21 arranged on the base 7. The plate 5 is supported, on each of its lateral sides, by two rollers 22 and 23 respectively, each engaged in a groove 24 and 25, these grooves being made on the uprights 18 and 19 of the structure in a way which will be described later. In particular, according to the invention, these grooves are arranged in such a way that the distance separating the rollers 22 and 23 associated with each of these uprights remains invariable, and that the line connecting them permanently forms a constant angle with the plane of the plate 5, marked by a given reference line on the support of the article, whatever the position of the plate over the height of the bearing structure and therefore whatever the position of this plate in the vicinity of the surface 1. In the example described and illustrated, the above-mentioned angle is selected as substantially equal to 45°.

Figure 3:
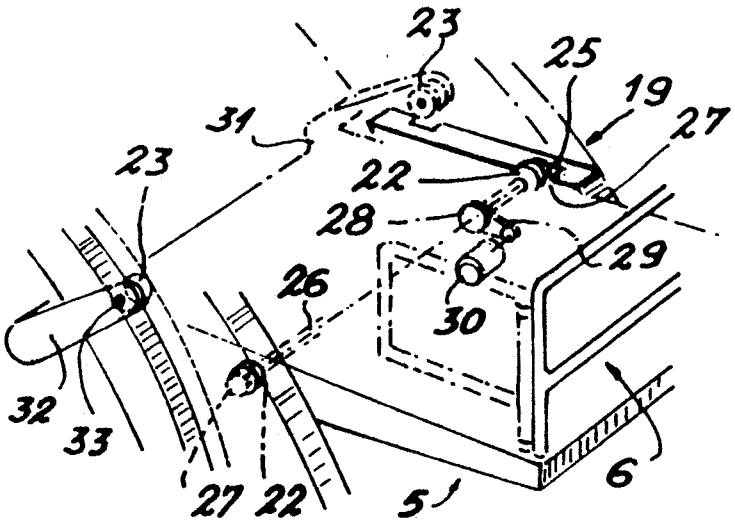
FIG. 3 is a perspective view of the plate forming the support of the article to be displaced along the curvature of the component and guiding and driving means carried by this plate.

FIG. 3 shows in more detail the embodiment of the plate 5 and the mounting of the guide rollers 22 and 23 on the latter. In particular, this plate is equipped with a first rotary shaft 26 passing freely through the sides of the plate and pivoting relative to the latter in supporting bearings (not shown), the shaft 26 possessing a roller 22 at each of its ends projecting from the lateral sides of the plate towards the uprights 18 and 19 respectively. Each of the rollers 22 is associated, furthermore, with a pinion 27 keyed on the shaft 26 and arranged in the immediate vicinity of the roller in a plane parallel to this, a similar arrangement of course being provided at the opposite end of the shaft 26. Moreover, in its middle part, the shaft 26 has a drive pinion 28 interacting by way of a transmission 29 with a geared control motor 30 carried by the plate and making it possible to drive in rotation, in one direction or the other, the shaft 26 and consequently the two pinions 27 which it carries at its ends, in order, depending on the direction of its rotation, to cause the ascent or descent of the plate on the uprights 18 and 19 of the bearing structure 3.

Figure 6:
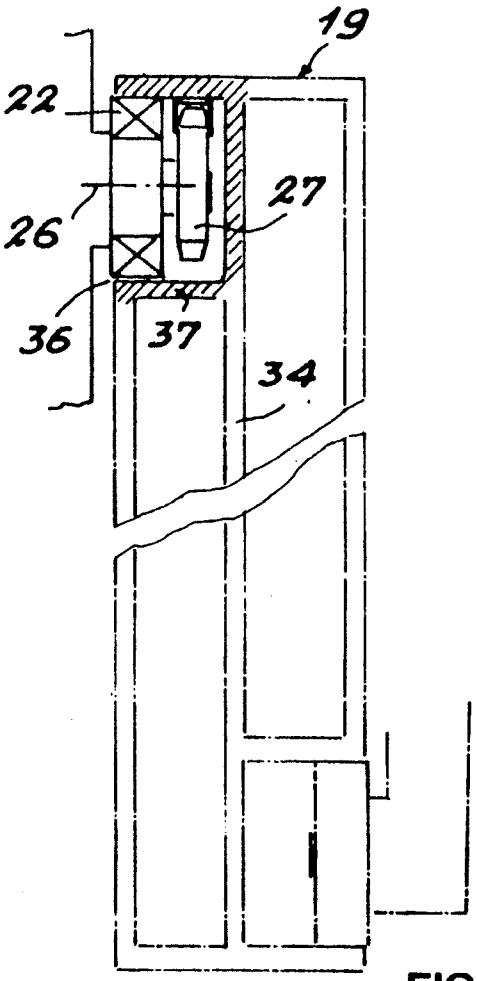
FIGS. 4, 5 and 6 are cross-sections through one of the uprights of the ground-bearing structure of the apparatus respectively along the lines A—A, B—B, C—C of FIG. 1, taken at various levels of this structure.
Figure 5:
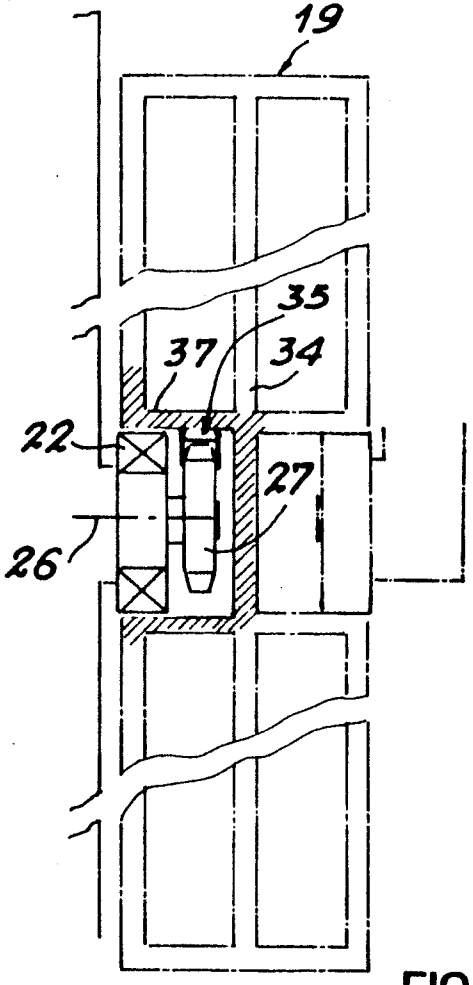
Figure 4:
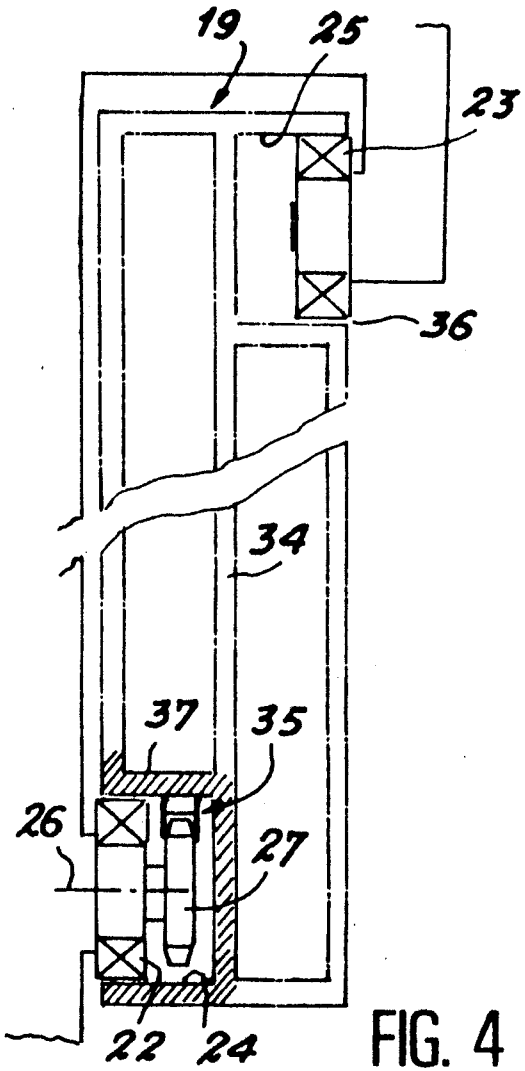

Furthermore, the plate 5 possesses, extending parallel to the rotary shaft 26, a second shaft 31 which likewise passes through the plate, but which is immobilized relative to this by welding or another suitable fastening means. Fastened to each of the ends of the shaft 31 projecting from the lateral sides of the plate is a crank pin 32, the orientation of which is determined by virtue of construction, in particular with a suitable inclination to ensure that the roller 23, mounted freely on an axle 33 provided on the crank pin opposite the shaft 31 and parallel to this, is set apart from the roller 22 carried by the shaft 26 at a specific distance remaining invariable, whatever the position of the plate on the bearing structure. In the same way as for the shaft 26, the shaft 31 supports at its opposite end another roller 23 mounted on a similar crank pin, so as to be arranged opposite the matching roller carried by the shaft 26 in an exactly identical position As already stated, the rollers 22 and 23 are mounted respectively in the grooves 24 and 25 provided in the uprights 18 and 19 and disposed on these in an arrangement which FIGS. 4, 5 and 6 make it possible to explain in more detail. These figures show cross-sections through one of the uprights at different levels of the latter, here the upright 19, on the understanding, of course, that arrangements exactly similar to and symmetrical to the first are used on the upright 18.

Each of the uprights 18 and 19 comprises particularly a central web 34 which extends in a vertical plane and against the opposite surfaces of which are arranged the respective grooves 24 and 25, these receiving the rollers 22 and 23. The groove 24 also possesses, in line with the pinion 27 associated with the roller 22, a toothing or chain 35 immobilized or otherwise fastened in the bottom of the groove, so as to make it possible, when it interacts with the pinion, to ensure the displacement of the plate 5 relative to the bearing structure 3 by reaction. The roller 23 is itself engaged in the second groove 25, the two rollers 22 and 23 providing, together with the lateral walls of the grooves 24 and 25 against which they bear, plays 36 which can be cancelled, depending on whether the corresponding roller rolls on one of these walls or the other. Preferably, each groove is delimited by means of a section 37 produced integrally or attached and welded to the web 34, the form of these sections being such that the open grooves 24 and 25 which they thus delimit intersect in space over the height of the bearing structure, naturally without interfering with one another since they each remain located on one of the two opposite faces of the central web 34 and on the other. The cross-sections A—A, B—B and C—C corresponding respectively to FIGS. 4, 5 and 6 thus show the relative arrangement in space of the grooves 24 and 25 and therefore of the rollers received in these grooves, the profile of the latter being designed so that, according to the invention, the angle of the line connecting the rollers 22 and 23 and the plane of the plate permanently remains invariable and preferably, in the example in question, equal to 45°, as already stated above.

This affords an arrangement of very simple design which makes it possible to avoid the use of conventional solutions employing footbridges, ladders or other scaffolding which are unsuitable and vertically adjustable only with difficulty and which permanently obstruct the work zone, this equipment also being liable to risk damaging the surface of the installation by pressing against it or bearing directly on it. The structure provided can, by virtue of its construction, be produced easily so as itself to have a profile partially surrounding the component or installation, the surface of which is to be followed or checked, the curvature of the grooves receiving the rollers being determined so as to ensure an invariancy in space of the plane of the plate and therefore of the relative orientation of the two guide rollers, the selected angle between these two directions being determined in order to absorb as effectively as possible the bending moments exerted on the structure according to the successive positions of the plate on the structure.

It goes without saying, of course, that the invention is not limited to the exemplary embodiment more especially described and illustrated above; on the contrary, it embraces all its alternative versions. In particular, it is clear that the form of the uprights of the bearing structure could easily be adapted to any profile of the surface to be followed, and the latter can have successive concave or convex parts, the grooves intersecting with one another as many times as necessary in order always to keep equal to itself the angle of the reference line of the plate and the relative direction of the two guide rollers.

I claim:

1. An apparatus for displacing an article or a person in parallel with a surface having a curved profile comprising:

a planar support having a first and second transverse shaft, the first shaft being rotatably mounted, and the second shaft being fixed to the planar support, each of said transverse shafts supporting a pair of rollers;

a bearing structure having a profile which corresponds substantially to said surface curved profile, supported at one end on the ground, said bearing structure including a pair of spaced-apart upright members, each having separate rail-forming grooves, one groove opening outwardly away from the other upright member and another groove opening inwardly toward the other upright member, receiving said rollers, said grooves having a profile which is a function of the curvature of the surface and which maintains an axis of said rollers oriented parallel during movement of said support and oriented at a constant angle with respect to said support; and power means for rotating said first shaft and moving said rollers in said grooves, thereby moving said support along said profile parallel to said surface.

2. The apparatus, as claimed in claim 1, wherein the angle formed by the axis connecting the rollers and the reference line of the support is substantially 45°.

3. The apparatus as claimed in claim 1, wherein one of the rollers is mounted and detained at the end of the first rotary shaft with a pinion for controlling the displacement of the plate keyed on the shaft parallel to the roller, said pinion driven by a motor carried by the plate while engaging with a chain or a toothing mounted and immobilized in the bottom of the groove.

4. The apparatus as claimed in claim 3, wherein a roller is mounted loosely on an axis carried by a crank pin fixed to the end of said second shaft on an axis parallel to said second shaft, the crank pin being keyed on said second shaft with a specific fixed orientation, defining, in combination with the position of the two shafts on the plate, the invariable distance between the two rollers.

5. The apparatus as claimed in claim 1, wherein each upright of the bearing structure comprises a central metal web, having opposite faces fastened to bent sections of a U-shaped cross-section, delimiting the open grooves receiving the rollers with a play within these grooves which is cancelled, depending on whether the roller rolls on one of the opposite sides of the section or the other, as a function of the direction of the displacement of the support of the article in relation to the bearing structure.

6. The apparatus as claimed in claim 1, wherein the plate supports a protective cage for an operator which is displaced according to the height of the structure in relation to the surface.

7. The apparatus as claimed in claim 1, wherein the bearing structure is mounted on wheels, so that it can be displaced on the ground and shifted as far from or as near to the surface as possible.

8. The apparatus as claimed in claim 1, wherein the bearing structure includes means for immobilizing movements on the ground and means for inclining said uprights, to bring them into the immediate vicinity of the profile of the surface.

* * * * *